United States Patent [19]

Shimamura et al.

[11] 4,147,546

[45] Apr. 3, 1979

[54] PREVENTION OF FOG FORMATION IN COLOR PHOTOGRAPHIC PROCESS

[75] Inventors: Isao Shimamura; Haruhiko Iwano, both of Minami-ashigara, Japan

[73] Assignee: Fuji Photo Film Co., Ltd., Minami-ashigara, Japan

[21] Appl. No.: 788,879

[22] Filed: Apr. 19, 1977

[30] Foreign Application Priority Data

Apr. 19, 1976 [JP] Japan ..... 51-44780

[51] Int. Cl.[2] ..... G03C 5/38; G03C 7/16; G03C 5/26; G03C 5/32

[52] U.S. Cl. ..... 96/60 R; 96/22; 96/50 A; 96/61 M; 96/63

[58] Field of Search ..... 96/60 R, 50 A, 66, 22, 96/61 R, 61 M, 63, 48 R; 210/23 H, 23 F, 321 R, 321 A

[56] References Cited

U.S. PATENT DOCUMENTS

| | | | |
|---|---|---|---|
| 3,746,543 | 7/1973 | Iwano et al. | 96/50 A |
| 3,846,130 | 11/1974 | Porol et al. | 96/22 |
| 3,923,511 | 12/1975 | Bissonette | 96/60 R |
| 3,989,526 | 11/1976 | Bissonette | 96/48 R |
| 3,997,347 | 12/1976 | Parsonage | 96/50 A |
| 4,040,834 | 8/1977 | Iwano | 96/60 R |

FOREIGN PATENT DOCUMENTS

| | | | |
|---|---|---|---|
| 709179 | 5/1954 | United Kingdom | 96/50 |

*Primary Examiner*—Mary F. Kelley
*Attorney, Agent, or Firm*—Sughrue, Rothwell, Mion, Zinn and Macpeak

[57] ABSTRACT

A photographic process for forming photographic images comprising processing a photographic element comprising a support and at least a silver halide photographic emulsion layer having image-wise distributed therein a material possessing a catalytic action with a cobalt (III) complex with a photographic processing solution containing at least a cobalt (III) complex having a coordination number of 6 in the presence of a primary aromatic amine developing agent, in which the formation of fog is prevented by contacting the photographic processing solution with one side of a fine open-cell porous diaphragm of a hydrophobic material, such as a porous Teflon film, the other side of which is in contact with an acid solution, whereby fogging components in the processing solution are removed from the processing solution into the acid solution through the porous diaphragm.

16 Claims, No Drawings

PREVENTION OF FOG FORMATION IN COLOR PHOTOGRAPHIC PROCESS

BACKGROUND OF THE INVENTION

1. Field of the Invention

The present invention relates to an image intensification process for a photographic element having image-wise distributed therein a material possessing a catalytic action with a cobalt (III) complex. More particularly, the invention relates to a process of preventing the formation of fog in a color photographic process by removing fogging components from a photographic processing solution through a hydrophobic porous diaphragm.

2. Description of the Prior Art

It is known that after exposing a photographic material containing light-sensitive metal salts, images of a catalytically active metal belonging to Group VIII, Group VIa or Group Ib of the periodic table by chemical development or physical development and dye images or tanning images can be formed in the photographic element using a reducing agent or using a reducing agent and color couplers in the presence of hydrogen peroxide or a hydroperoxide. For example, descriptions of this image forming method appear in German Patent Applications (OLS) Nos. 1,813,920 (corresponding to U.S. Pat. No. 3,674,490), 1,950,102, 1,995,901, 1,961,029 (corresponding to U.S. Pat. No. 3,684,511), 2,044,833, 2,044,993 (corresponding to U.S. Pat. No. 3,761,265), 2,056,360 (corresponding to U.S. Pat. No. 3,776,730), 2,056,359 (corresponding to U.S. Pat. No. 3,765,890) and 2,120,091 (corresponding to U.S. Pat. No. 3,817,751) and Japanese Patent Applications Nos. 128,327/74 (corresponding to German Patent Application (OLS) No. 2,549,837) and 139,917/74 (corresponding to German Patent Application No. (OLS) 2,549,837).

In the field of color photography, a color photographic material prepared by coating on a support silver halide emulsions having incorporated therein couplers such as a cyan coupler, yellow coupler, and a magenta coupler using various technique is image exposed and then subjected to a series of processings for reproducing color images in the photographic material.

The fundamental processing steps of these processings are a color development step and a silver removal step. That is, in the color development step, silver halides of the exposed silver halide color photographic material are reduced by a color developing agent to form silver images and at the same time the oxidized color development agent reacts with the couplers to provide dye images. Thereafter, the color photographic material is subjected to a silver removal step, wherein the silver formed in the previous step is oxidized by the action of an oxidizing agent (also called a "bleaching agent"), dissolved then by a complexing agent for silver ions usually called a "fixing agent", and removed from the photographic material. Thus, dye images only remain in the photographic material. In practical photographic processing of color photographic materials, auxiliary processing steps are employed for maintaining the desired photographic and physical properties of color images or improving the storage stability of the color images in addition to the above-described two fundamental steps of color development and silver removal. For example, a hardening bath for preventing the photosensitive emulsion layers of color photographic materials from being excessively softened during processing, a stop bath for effectively stopping the development reaction, an image stabilization bath for stabilizing images, and a bath for removing a backing layer from the support of a photographic material, are illustrative of these auxiliary processing steps.

This kind of the color photographic processing has already been practiced on a world-wide basis in the photographic art since 1940.

The color photographic material used in the color photographic process as described above generally contains silver in an amount of about 1 to about 15 g per square meter of the color photographic material in the form of silver halide. For example, reflection-type image forming materials represented by color papers usually contain about 1 to about 2.5 g of silver per square meter of the photographic material and photographic materials such as color photographic negative films and color photographic reversal films contain about 3 to about 9 g of silver per square meter of the photographic material. This amount of silver is necessary for obtaining a sufficient dye image density but if the amount of silver required can be reduced, the advantage is large from the standpoint of conservation of silver as a resource as well as reduction of the manufacturing cost of the photographic materials.

U.S. Pat. No. 3,674,490 discloses a process of reducing the amount of silver halides used in photographic materials using a color intensification process. According to the process of the patent, metal images distributed in an image-wise manner in the photographic material activate hydrogen peroxide or another peroxide as a catalyst to cause an oxidation reaction to occur, whereby dyes are formed and color images are ultimately formed. In this case, the amount of the metal images may be very small since the metal images may act as a catalyst and hence when silver is employed for such metal images in the process, a desired color density can be obtained using a greatly reduced amount of silver salts as compared with that used in gelatino silver halide emulsions of conventional types. In this process, the peroxide is used in the intensification step added as a subsequent step to a development step represented by color development.

However, this process has various disadvantages. For example, peroxides such as, for example, hydrogen peroxide, etc., are very unstable in aqueous solution. In particular, a peroxide is very unstable when a developer is carried over and is readily decomposed to reduce greatly the image intensification effect. Furthermore, the intensification treatment with a peroxide is accompanied by the formation of severe amount of fog. Still further, peroxides have adverse effects on living bodies and a possibility of an explosion occurring exists. Hence, the handling of these materials requires specific care.

U.S. Pat. Nos. 3,826,652, 3,834,907, 3,748,138 and 3,765,891 describe a process of reducing the amount of silver halides used in photographic materials using another novel color intensification process. According to the process as described in the above patents, metal images image-wise distributed cause an oxidation-reduction reaction by a cobalt (III) complex such as, for example, $[Co(CH_3)_6]Cl_3$ as a catalyst, to occur to form dyes and to provide color images. However, this process also has a serious disadvantage in that if developer components such as a developing agent are present together with the cobalt (III) complex, fog forms markedly on the color photographic images.

Depending on the manner of processing, the image intensification process using a cobalt (III) complex can be classified fundamentally into the following three types of processes. That is, (1) a three bath processing comprising a color development, an intensification, and a blix; (2) a two bath processing comprising a color development-intensification and a blix; and (3) a mono bath processing comprising a color development-intensification-blix. Among these processings, the processing solutions in the two bath processing and the mono bath processing are very unstable since in these cases a cobalt (III) complex is present together with developer components in the processing solutions and, thus, if these processings are not performed at room temperature (e.g., about 20°-30° C.) within a few hours, the image intensification effect is reduced and a marked degree of fog forms. In the three bath processing wherein the developer and the intensification solution are used separately, it is expected that the processing compositions can be used or stored for a longer period of time. However, in the three bath processing, a water washing step is not employed between the color development and the intensification step or water washing or rinsing is carried out, if employed, in a very short period of time and hence in the running processing, about 10 to 30% of the development components usually are carried over into the intensification solution from the developer. Therefore, the three bath processing is also accompanied by the formation of a severe degree of fog.

In order to overcome the above-described difficulties caused by the use of the cobalt (III) complex, it is most preferred to incorporate the cobalt (III) complex in color photographic materials. These techniques are described in, for example, Japanese Patent Applications Nos. (OPI) 84,229/74 (corresponding to German Patent Application No. (OLS) 2,357,695), 84,239/74 and 97,614/74 (corresponding to U.S. Pat. No. 3,847,619). However, this system involves another serious disadvantage in that the sensitivity of the silver halide is greatly reduced.

As another method of overcoming the above-described difficulties, incorporation of an organic anti-foggant in the processing solution containing the cobalt (III) complex has been proposed. Such organic anti-foggants which can be used include known nitrogen-containing heterocyclic compounds and mercapto-substituted nitrogen-containing heterocyclic compounds. The addition of these heterocyclic compounds may reduce the formation of fog to some extent but, at the same time, reduces greatly the image density formed.

SUMMARY OF THE INVENTION

A primary object of this invention is to prevent the occurrence of the serious disadvantages in image intensification using a cobalt (III) complex.

That is, an object of this invention is to provide a process for preventing the formation of fog occurring to a marked degree when a cobalt (III) complex is present together with developing components.

The object of this invention is attained by the process of this invention as described below.

The process of this invention comprises forming images by processing an exposed photographic element comprising a support and at least a silver halide photographic emulsion layer having image-wise distributed therein a material processing a catalytic activity thereon with a photographic processing solution containing at least a cobalt (III) complex having a coordination number of 6 in the presence of a primary aromatic amine developing agent, in which the formation of fog is prevented by contacting the photographic processing solution with one side of a fine open-cell porous diaphragm of a hydrophobic material, the other side of which is in contact with an acid solution, whereby fogging components in the processing solution are removed from the processing solution into the acid solution through the porous diaphragm.

DETAILED DESCRIPTION OF THE INVENTION

The cobalt complex used in the present invention is an inert complex of trivalent cobalt (Cobalti-complex) which exhibits a slow ligand exchange reaction velocity.

The term "inert complex" refers to complexes of a cobalt ion with a ligand which, when a test sample thereof is dissolved at 0.1 molar concentration at 20° C. in an inert solvent solution also containing 0.1 molar concentration of a tagged ligand of the same species which is uncoordinated, such exhibits essentially no exchange of uncoordinated and coordinated ligands for at least 1 min., and preferably for at least several hours, such as up to 5 hours or more. Reference can be made to: (1) *Chem. Rev.*, Vol. 50, page 69, (1952), (2) Basolo and Pearson, *Mechanism of Inorganic Reactions, A study of Metal Complex and Solutions,* 2nd Ed., (1967).

Appropriate cobalt complexes can be formed using various ligands and cobalt ions. Almost all Lewis bases (that is, materials having unshared electron pairs) can be the ligands of the cobalt complexes. Typical examples of useful ligands include not only ordinary ligands as described in Basolo and Pearson, *Mechanism of Inorganic Reactions, A Study of Metal Complexes and Solutions,* 2nd Edition, John Wiley and Sons, New York (1967), but also various halides such as chloride, bromide, fluoride and nitrite, water, ammine, etc.

The stability of the ligand in a complex depends upon the property of the ligand selected for forming the complex.

A particularly useful cobalt complex which is used in this invention has a coordination number of 6 and is a complex of cobalt with a ligand or ligands selected from the group consisting of ethylenediamine, diethylenetriamine, triethylenetetramine, amine ($NH_3$), nitrate, nitrite, azide, chloride, thiocyanate, isothiocyanate, water, carbonate, and ethylenediamine tetraacetic acid. Preferred cobalt complexes of the above-described cobalt complexes have (1) at least 2 ethylenediamine ligands, (2) at least 5 amine ligands, or (3) at least one triethylenetetramine ligand. Particularly preferred cobalt complexes are cobalt hexamine salts (e.g., chlorides, bromides, sulfites, sulfates, perchlorates, nitrites and acetates). Other examples of highly useful cobalt complexes include: $[Co(NH_3)_6]X$, $[Co(NH_3)_5H_2O]X$, $[Co(NH_3)_5CO_3]X$, $[Co(NH_3)_5Cl]X$, $[Co(NH_3)_4CO_3]X$, cis-$[Co(en)_2(N_3)_2]X$, trans$[Co(en)_2Cl(NCS)]X$, trans$[Co(en)_2(N_3)_2]X$, cis$[Co(en)_2(N_3)N_3]X$, cis$[Co(en)_2Cl_2]X$, trans$[Co(en)_2Cl_2]X$, $[Co(en)_2(SCN)_2]X$, and $[Co(en)_2(NCS)_2]X$, wherein X represents one or more anions such as bromide, chloride, nitrite, perchlorate, acetate, carbonate and sulfate, the number of the anions being determined by electrical neutrality rules, and (en) represents ethylenediamine.

The following anions are arranged in the order of increasing stability of the cobalt hexamine complex: that is, bromide, chloride, nitrite, perchlorate, acetate, carbonate, sulfite, and sulfate. Other useful ions are hydrochlorides, nitrates, thiocyanates, dithionates, and hydroxides.

A neutral complex such as $[Co(dien)(SCN)_2OH]$ where dien is diethylenetriamine is useful but positively charged complexes are generally preferred.

The amount of the cobalt (III) complex usually used in the process of this invention is about 0.01 to about 200 g, preferably 0.05 to 100 g, more preferably 0.1 to 50 g, per liter of the photographic processing solution.

The fine open-cell porous diaphragm of a hydrophobic material can comprise polytetrafluoroethylene alone or can be a mixture of polytetrafluoroethylene and polyethylene, polypropylene, polyvinyl chloride or the like. The content of polytetrafluoroethylene in the open-cell porous diaphragm used in this invention is higher than about 50%, preferably higher than 70%. The mean pore size of the porous diaphragm is about 0.1 to about 1,000 microns (ASTM method), preferably 0.2 to 100 microns, more preferably 0.5 to 50 microns. Also, a suitable thickness for the porous diaphragm is about 0.01 to about 5 mm, preferably 0.1 to 2 mm. These fine open-cell porous diaphragms of hydrophobic materials are described in, for example, Japanese Patent Application No. (OPI) 7,284/71, Japanese Patent Publications Nos. 13,560/67 and 41,265/74 and U.S. Pat. Nos. 3,315,020 and 3,664,915.

The fine open-cell porous diaphragm is usually used in the form of a film or tube in the process of this invention. Where the porous diaphragm is used in a tubular form, a tube having a diameter of about 0.1 mm to about 10 cm, preferably 1 to 10 mm is used.

Other fine open-cell porous materials of hydrophobic materials than those described above can be used in the process of this invention if the porous materials have the same function as that of the above-described materials.

In a particularly effective embodiment of the process of this invention, the fine open-cell porous diaphragm is placed between the photographic processing solution containing the cobalt (III) complex and an aqueous solution of an inorganic acid or an organic acid. In using the porous diaphragm as a porous tube, an aqueous solution of an inorganic acid or an organic acid is placed in the porous tube with or without circulation therethrough and the photographic processing solution containing the cobalt (III) complex is placed outside the porous tube with or without stirring. As another process, the processing solution containing the cobalt (III) complex may be placed in the porous tube and an aqueous solution of an inorganic acid or an organic acid may be placed outside the porous tube.

Examples of suitable inorganic acids which can be used for the purpose are hydrochloric acid, nitric acid, sulfuric acid, phosphoric acid, and boric acid and examples of suitable organic acids which can be used for the above-described purpose are acetic acid, propionic acid, maleic acid, citric acid, oxalic acid, malic acid and toluenesulfonic acid. As the case may be, both the inorganic acid and the organic acid may be used simultaneously and further a salt such as sodium chloride and sodium sulfate may be added, if desired, to an aqueous solution of the acid. Moreover, an organic solvent soluble in water, such as an alcohol may be added to the aqueous acid solution. The concentration of the acid in the aqueous solution is about 0.001 to 10 mol/l, preferably 0.01 to 5 mol/l.

A suitable temperature which can be employed with the process of this invention can range from about 10° to about 70° C.

When the present invention is applied to a used developer such as 400 ml of a used developer having a fogging optical density of 0.54, about 4 hours of treatment with 400 ml of 0.5 M aqueous phosphoric acid solution through a porous Teflon film having an area of 60 $cm^2$ is sufficient for regeneration of the used developer, i.e., the fog optical density of the used developer is decreased from 0.54 to a value which is acceptable for practical use such as less than about 0.12. The treatment time proportionally depends on the amount of the used developer, the concentration of the acid solution, the fog optical density of the used developer and area of the porous Teflon film employed, etc. Further, the longer the treatment time, the smaller the value of fog in the regenerated developer.

The developing agent used in this invention may be incorporated into the photographic processing solution and/or the photographic element. The term "photographic processing solution" as used herein means a developer or an intensification solution. When the developing agent is incorporated into the photographic element, it can be incorporated into a silver halide emulsion layer and/or a non-photosensitive auxiliary layer adjacent the silver halide emulsion layer.

Typical examples of preferred p-phenylenediamine derivative color developing agents which can be used as the developing agent in this invention are N,N-diethyl-p-phenylenediamine hydrochloride, 2-amino-5-diethylaminotoluene hydrochloride, 2-amino-5-(N-ethyl-N-laurylamino)toluene, 4-[N-ethyl-N-(β-hydroxyethyl-)amino]aniline sulfate, 2-methyl-4-[N-ethyl-N-(β-hydroxyethyl)amino]aniline sulfate, N-ethyl-N-(β-methanesulfonamidoethyl)-3-methyl-4-aminoaniline sesquisulfate monohydrate described in U.S. Pat. No. 2,193,015, N-(2-amino-5-diethylaminophenylethyl)methanesulfonamide sulfate described in U.S. Pat. No. 2,592,364, N,N-dimethyl-p-phenylenediamine hydrochloride, and 4-amino-3-methyl-N-ethyl-N-methoxyethylaniline, 4-amino-3-methyl-N-ethyl-N-β-ethoxyethylaniline and 4-amino-3-methyl-N-ethyl-N-β-butoxyethylaniline described in U.S. Pat. Nos. 3,656,950 and 3,698,525 as well as the salts (e.g., the sulfates, hydrochlorides, sulfites, p-toluenesulfonates, etc.) of these materials. A suitable amount of the developing agent present in the developer can range from about $1 \times 10^{-3}$ to $1 \times 10^{-1}$ mol/l.

Other examples are described in *Kagaku Shashin Binran,* Vol. 2, page 72, Maruzen Shuppan Sha (1959) and L. F. A. Mason, *Photographic Processing Chemistry,* pages 226 to 229, Focal Press, London (1966).

p-Aminophenol derivatives may be also used as the reducing agent. In this case, the above-described couplers are incorporated into the photographic elements or the photographic processing solutions in case of forming photographic images. A typical example of this type of reducing agent is, for example, p-aminophenol sulfate.

The pH of the photographic processing solution containing the cobalt (III) complex can range from about 7 to about 14, in particular, 8 to 11.

The photographic processing solution may further contain other known developer component compounds such as sodium hydroxide, potassium hydroxide, sodium carbonate, potassium carbonate, sodium tertiary phosphate, potassium tertiary phosphate, potassium metaborate, and borax individually or as a combination thereof as an alkali agent, a buffer, etc. Also, for providing a buffer function to the processing solution, for convenience in preparing the processing solution, or for increasing the ionic strength of the processing solution, various salts such as disodium hydrogenphosphate, dipotassium hydrogenphosphate, potassium dihydrogenphosphate, sodium dihydrogenphosphate, sodium hydrogencarbonate, potassium hydrogencarbonate, boric acid, an aliali metal (e.g., sodium, potassium and lithium) nitrate, and an alkali metal (e.g., sodium, potassium and lithium) sulfate may be added to the processing solution.

Furthermore, the photographic processing solution used in this invention may contain, if desired, a development accelerator. Examples of suitable development accelerators include various pyridium compounds and other cationic compounds as described in U.S. Pat. No. 2,648,604, Japanese Patent Publication No. 9,503/69 and U.S. Pat. No. 3,671,247; cationic dyes such as phenosafranine, etc.; neutral salts such as thallium nitrate and potassium nitrate; polyethylene glycol and the derivatives thereof as described in Japanese Patent Publication No. 9,504/69 and U.S. Pat Nos. 2,533,990, 2,531,832, 2,950,970 and 2,577,127; nonionic compounds such as polythioethers, etc.; and the organic solvents, organic amines, ethanolamine, ethylenediamine, diethanolamine, etc., as described in Japanese Patent Publication No. 9,509/69 and Belgian Pat. No. 682,862. Other examples of the development accelerators which can be used in this invention are described in L.F.A. Mason, *Photographic Processing Chemistry,* supra page 40–43, Focal Press (London).

Still other examples of the effective development accelerators which can be used in this invention are benzyl alcohol and phenylethyl alcohol described in U.S. Pat. No. 2,515,147 and pyridine, ammonia, hydrazine and the amines described in *Journal of The Society of Photographic Science and Technology of Japan,* Vol. 14, 74 (1952).

Also, the photographic processing solution may further contain hydroxylamine sulfate, hydroxylamine hydrochloride, sodium sulfite, potassium sulfite, or sodium hydrogensulfite.

In the process of this invention, another intensifier (e.g., another cobalt complex, a peroxide such as hydrogen peroxide, etc.), e.g., in an amount of about $1 \times 10^{-3}$ to 1 mol/l, may be used together with the cobalt (III) complex described above.

The intensifying solution used in the process of this invention may contain a desired anti-foggant. Examples of suitable anti-foggants which can be used in this invention are an alkali metal halide such as potassium bromide, sodium bromide, potassium iodide, etc., and organic anti-foggants such as nitrogen-containing heterocyclic compounds (e.g., benzotriazole, 6-nitrobenzimidazole, 5-nitroisoindazole, 5-methylbenzotriazole, 5-nitrobenzotriazole, and 5-chlorobenzotriazole); mercapto-substituted heterocyclic compounds (e.g., 1-phenyl-5-mercaptotetrazole, 2-mercaptobenzimidazole and 2-mercaptobenzothiazole); and mercapto-substituted aromatic compounds (e.g., thiosalicylic acid).

In particular, nitrogen-containing heterocyclic compounds which are free of mercapto groups are preferably used in this invention. A suitable amount of the anti-foggant is about 1 mg to about 5 g, preferably 5 mg to 1 g, per liter of the intensifying solution.

Still further, a polyphosphoric acid compound such as sodium hexametaphosphate, potassium hexametaphosphate, sodium tetrapolyphosphate, potassium tetrapolyphosphate, sodium tripolyphosphate, potassium tripolyphosphate, etc., and an aminopolycarboxylic acid such as ethylenediaminetetraacetic acid, nitrilotriacetic acid, cyclohexanediamine tetraacetic acid, iminodiacetic acid, N-hydroxymethyl ethylenediaminetetraacetic acid, diethylenetriaminepentaacetic acid, etc., can be usefully used in this invention as a water softener. The amount of the water softener used depends upon the hardness of water used but usually is about 0.5 to about 1 g/l.

Furthermore, a calcium sequestering agent and a magnesium sequestering agent can be also used in the photographic processing solutions in this invention. Suitable examples are described in detail in, for example, J. Willems, *Belgisches Chemiches Industry, Vol.* 21, 325 (1956) and ibid., Vol. 23, 1105 (1958).

A general example of the image-wise distributed material having a catalytic activity is a latent image, development centers, or partially or completely reduced developed silver formed in a silver salt photographic material.

As the case may be, the image-wise distributed material may be an image-wise distribution of a noble metal intensified by processing a latent image with a solution of a gold salt or a platinum salt. Also, as the case may be, it may be a silver image transferred to an image-receiving element from a photosensitive element using a silver salt diffusion transfer process or further may be an image-wise distribution of a noble metal such as silver and gold intensified by processing a latent image formed on a photoconductive material such as titanium oxide and zinc oxide with a solution of a silver salt or a gold salt. Still further, the image-wise distributed material may be a zero-valent metal selected from metals of Group Ib or Group VIII of the Periodic Table or further it may be a sulfide. Examples of the materials possessing particularly effective catalytic activity of the above-described various materials are platinum, palladium, copper, silver, gold, mercury, carbon, copper sulfide, and silver sulfide.

The developing agent is a compound which is oxidized by the cobalt (III) complex in the presence of the image-wise distributed material possessing a catalytic activity, which is oxidized, however, at a very low rate of reaction in areas where the material possessing a catalytic activity does not exist and which forms images by self-oxidation or forms images by reaction of the oxidation product thereof and a color coupler.

In general, photographic materials contain a silver salt in an amount of about 3 to about 10 g/m$^2$ as silver and, in general, printing materials contain about 1 to about 4 g/m$^2$ of silver. On the other hand, the photographic element used in the process of this invention contains about 10 mg/m$^2$ to less than about 5 g/m$^2$, in particular, less than 3 g/m$^2$, of silver and also in the multilayer color photographic material used in this invention, a suitable coating amount of silver in each photosensitive emulsion layer is less than about 2 g/m$^2$, in particular, 1 mg/m$^2$ to 1 g/m$^2$.

The color coupler used in this invention is a compound which forms a dye by reaction with the oxidized color developing agent. Examples of suitable couplers which can be used in this invention are couplers used in conventional color photographic materials, such as open chain ketomethylene couplers, 5-pyrazolone couplers, indazolone couplers, and phenol or naphthol couplers; diffusible dye releasing (DDR) couplers capable of releasing a diffusible dye by reaction with a color developing agent as described in British Pat. No. 840,731, U.S. Pat. No. 3,227,550, Japanese Patent Application No. (OPI) 123,022/74 and Japanese Patent Application No. 57,040/75; and amidrazone compounds capable of releasing a diffusible dye by reaction with the oxidation product of a color developing agent as described in Japanese Patent Publication No. 39,165/73.

In a typical embodiment of this invention, the couplers are incorporated into photographic materials and in this case the amount of the couplers used must be enough to provide sufficient coupling density. Therefore, the amounts of the couplers used are more than an equimolar amount to the silver present in the photographic materials. The couplers used may be selected as desired from known couplers.

Thus, in the typical embodiment of this invention, compounds capable of forming a dye by reaction with an oxidized color developing agent, that is, the so-called color couplers are incorporated in light-sensitive photographic emulsion layers of a color photographic material. These couplers have structures such that they do not diffuse into another layer or layers during the production or processing of the color photographic material.

The couplers which can be used in this invention are as follows:

Examples of yellow couplers which can be used in this invention are generally the open chain ketomethylene compounds as described in, for example, U.S. Pat. Nos. 3,341,331, 2,875,057 and 3,551,155, German Patent Application No. (OLS) 1,547,868, U.S. Pat. Nos. 3,265,506, 3,582,322 and 3,725,072, German Patent Application (OLS) No. 2,162,899, U.S. Pat. Nos. 3,369,895 and 3,408,194, German Patent Applications Nos. (OLS) 2,057,941, 2,213,461, 2,219,917, 2,261,361 and 2,263,875.

Examples of magenta couplers include 5-pyrazolone compounds mainly but indazolone compounds and cyanoacetyl compounds can also be used. Examples of these magenta couplers are described in, for example, U.S. Pat. Nos. 2,439,098, 2,600,788, 3,062,653 and 3,558,319, British Pat. No. 956,261, U.S. Pat. Nos. 3,582,322, 3,615,506, 3,519,429, 3,311,476 and 3,419,391, Japanese Patent Applications Nos. 21,454/73 and 56,050/73, German Pat. No. 1,810,464, Japanese Patent Publication No. 2,016/69, Japanese Patent Application No. 45,971/73 and U.S. Pat. No. 2,983,608.

Phenol derivatives or naphthol derivatives are mainly used as cyan couplers. Examples of these cyan couplers are described in, for example, U.S. Pat. Nos. 2,369,929, 2,474,293, 2,698,784, 2,895,826, 3,311,476, 3,458,315, 3,560,212, 3,582,322, 3,591,383, 3,386,301, 2,434,272, 2,706,684, 3,034,892 and 3,583,971, German Patent Application (OLS) No. 2,163,811, Japanese Patent Publication No. 28,836/70 and Japanese Patent Application No. 33,238/73.

In another embodiment of this invention, the socalled development inhibitor releasing couplers (DIR couplers) releasing a development inhibitor on coupling or compounds capable of releasing a development inhibiting compound on coupling may be added to the light-sensitive photographic emulsion layers of the color photographic material used in this invention. Examples of these compounds are described in, for example, U.S. Pat. Nos. 3,148,062, 3,227,554, 3,253,924, 3,617,291, 3,622,328 and 3,705,201, British Pat. No. 1,201,110, and U.S. Pat. Nos. 3,297,445, 3,379,529 and 3,639,417.

In order to obtain the characteristics required for color photographic materials, two or more kinds of the above-described couplers may be incorporated simultaneously in the same light-sensitive emulsion layer or the same kind of coupler may be incorporated in two or more light-sensitive silver halide emulsion layers.

The coupler incorporated in a unit layer in this invention is a color coupler, insoluble in water, mixed with a coupler solvent, preferably a coupler solvent having an appropriate polarity. Examples of typical solvents which can be used are tri-o-cresyl phosphate, trihexyl phosphate, dioctylbutyl phosphate, dibutyl phthalate, diethyllaurylamide, 2,4-diallylphenol, and the liquid dye stabilizers described in *Improved Photographic Dye Image Stabilizing Solvents, Product Licensing Index,* Vol. 83, 26–29 (March, 1971). The color photographic element containing the coupler solvent seems to absorb a color developer during the step of transferring the element from a developer bath into the intensification bath.

It is convenient to select the photographic color couplers used in this invention so that they give intermediate scale images. It is also preferred for the maximum absorption band of the cyan dye formed from the cyan coupler to be from about 600 nm to about 720 nm, the maximum absorption band of the magenta dye formed from the magenta coupler to be from about 500 nm to about 580 nm, and the maximum absorption band of the yellow dye formed from the yellow coupler to be from about 400 nm to about 480 nm.

The silver halide emulsion used in this invention is prepared usually by mixing an aqueous solution of a water-soluble silver salt such as silver nitrate and an aqueous solution of a water-soluble halide such as potassium bromide in the presence of an aqueous solution of a water-soluble polymer such as gelatin. Examples of suitable silver halides which can be used in this invention are silver chloride, silver bromide, and mixed silver halides such as silver chlorobromide, silver iodobromide, silver chloroiodobromide, etc.

The form of these silver halide grains may be that of a cubic system, an octahedral system, or a mixed crystal system.

Also, the silver halide emulsion used in this invention may be prepared by mixing two or more silver halide photographic emulsions prepared separately. Furthermore, the silver halide grains may have a uniform crystal structure throughout the entire grain, or may have a layer structure with different properties between the outer portion and the inner portion of the grain, or further may be a conversion type grain as described in British Pat. No. 635,841 and U.S. Pat. No. 3,622,318. Furthermore, the silver halide grains used in this invention may be the type forming a latent image mainly at the surface of the silver halide grains or may be the type forming a latent image in the inside of the silver halide grains. These silver halide emulsions may be prepared using the ammonia method, the neutralization method, the acid method, etc., which are described in C.E.K. Mees & T.H. James, *The Theory of the Photographic Process,* Macmillan Co., New York (1967) and P. Grafkides, *Chimie Photographique,* Paul Montel, Paris (1957).

The silver halide emulsion used in this invention can be chemically sensitized in conventional manner. Examples of chemical sensitizers which can be used for this purpose are the gold compounds such as chloroaurate and gold trichloride as described in U.S. Pat. Nos. 2,399,083, 2,540,085, 2,597,856 and 2,597,915, the salts of noble metals such as platinum, palladium, iridium, rhodium and ruthenium as described in U.S. Pat. Nos. 2,448,060, 2,540,086, 2,566,245, 2,566,263 and 2,598,079, the sulfur compounds capable of forming silver sulfide by reacting with a silver salt as described in U.S. Pat. Nos. 1,574,944, 2,410,689, 3,189,458 and 3,501,313 and the stannous salts, amines and other reducing materials as described in U.S. Pat. Nos. 2,487,850, 2,518,698, 2,521,925, 2,531,926, 2,694,637, 2,983,610 and 3,201,254.

It is preferred for various additives to be incorporated in the photographic element for obtaining desired development characteristics, image characteristics, film properties, etc. Examples of these additives include an iodide such as an alkali metal iodide, etc., and organic compounds having a mercapto radical such as phenylmercaptotetrazole, etc., but it is desirable to avoid using a large amount of these additives.

Anti-foggants which are generally incorporated in light-sensitive silver halide emulsion layers and non-light-sensitive auxiliary layers of photographic materials may be used together with the compounds of this invention.

Other additives employed generally in the field of photography, such as a hardening agent, a plasticizer, a lubricant, a surface active agent, a brightener, etc., may be also incorporated in the photographic elements used in this invention.

Examples of suitable hydrophilic colloids which can be used in this invention are gelatin, colloidal albumin, casein, carboxymethyl cellulose, hydroxyethyl cellulose, agar agar, sodium alginate, starch derivatives, and synthetic hydrophilic colloids such as, for example, polyvinyl alcohol, poly-N-vinylpyrrolidone, polyacrylic acid polymers, polyacrylamide, and the derivatives and partially hydrolyzed products of these polymers. If desired, these hydrophilic colloids can be used as a mixture of two or more compatible colloids. Gelatin is most generally used of the above-described materials but a part or all of the gelatin can be replaced by a synthetic polymer. Furthermore, a so-called gelatin derivative may be used as the hydrophilic colloid.

The photographic silver halide emulsion used in this invention can be, if desired, subjected to a spectral sensitization or super-sensitization using cyanine dyes such as cyanine, merocyanine, carbocyanine, etc., individually or as a combination thereof, or further as a combination thereof with styryl dyes, etc. These dye sensitization techniques are well known and are described in, for example, U.S. Pat. Nos. 2,493,748, 2,519,001, 2,977,229, 3,480,434, 3,672,897, 3,703,377, 2,688,545, 2,912,329, 3,397,060, 3,615,635, 3,628,964, British Pat. Nos. 1,195,302, 1,242,588, 1,293,862, German Patent Applications (OLS) Nos. 2,030,326 and 2,121,780, Japanese Patent Publications Nos. 14,030/69, 4,936/68 and 10,773/68, U.S. Pat. Nos. 3,511,664, 3,522,052, 3,527,641, 3,615,613, 3,615,632, 3,617,295, 3,635,721 and 3,694,217 and British Pat. Nos. 1,137,580 and 1,216,203. These dye sensitization techniques may be appropriately selected depending on the wavelength region, sensitivity, etc., to be sensitized and the object and the uses of the color photographic materials.

The photographic element used in this invention has at least one silver halide emulsion layer on a support and usually has a red-sensitive silver halide emulsion layer, a green-sensitive silver halide emulsion layer, and a blue-sensitive silver halide emulsion layer on a support. In another embodiment, the photographic element used in this invention has on a support a red-sensitive silver halide emulsion layer containing a cyan dye image forming coupler, a green-sensitive silver halide emulsion layer containing a magenta dye image forming coupler, and a blue-sensitive silver halide emulsion layer containing a yellow dye image forming coupler. Such a photographic element may have additional non-photosensitive photographic layers such as an antihalation layer, interlayers for preventing the occurrence of color mixing, a yellow filter layer, a protective layer, etc., in addition to the above-described silver halide photographic emulsion layers. Also, there is no particular limitation on the order of the positioning of the light-sensitive silver halide emulsion layers and, for example, the photographic element may have on a support a red-sensitive layer, a green-sensitive layer, and a blue-sensitive layer or a blue-sensitive layer, a red-sensitive layer, and a green-sensitive layer or further a red-sensitive layer, a green-sensitive layer, and a blue-sensitive layer, in order from the support side. Also, the photographic element may have various layer structures, for example, the silver halide emulsion layer may be composed of a plurality of silver halide emulsion unit layers as described in U.S. Pat. No. 3,726,681, British Pat. Nos. 818,687 and 923,045, U.S. Pat. No. 3,516,831 and Japanese Patent Applications Nos. 5,179/75 and 42,541/75.

The supports usually used for photographic materials can be used as a support for the photographic elements used in this invention. Suitable supports include, for example, a cellulose nitrate film, a cellulose acetate film, a cellulose butyrate film, a cellulose acetate butyrate film, a cellulose acetate propionate film, a polystyrene film, a polyethylene terephthalate film, a polycarbonate film, laminated films of the above-illustrated films, a thin glass sheet, a paper, etc. A baryta-coated paper or a paper having a polymer or a copolymer of an $\alpha$-olefin having 2 to 10 carbon atoms, such as polyethylene, polypropylene, an ethylene-butene copolymer, etc., coated or laminated thereon can be also used as the support for the photographic element. Furthermore, a synthetic resin film the surface of which has been matted to improve adhesion to other polymers as described in Japanese Patent Publication No. 19,068/72 can also be used as the support.

The support employed may be transparent or opaque depending on the purposes of the photographic materials. Also, when a transparent support is employed, not only a colorless transparent support but also a colored transparent support with dyes or pigments incorporated therein may be employed. Such a colored transparent support has already been used for X-ray films, etc., and is described in *J. SMPTE*, 67, 296 (1958).

Examples of opaque supports include a paper which is intrinsically opaque as well as an opaque film prepared by incorporating dyes or pigments such as titanium oxide into a transparent film, a synthetic resin film subjected to a surface treatment using the method as described in Japanese Patent Publication No. 19,068/72 and a paper or a synthetic resin film rendered completely light intercepting by the addition of carbon black, dyes, etc. The support may have a subbing layer providing both good adhesivity to the support and a photographic silver halide emulsion layer. Also, for further improving the adhesive properties of the support, the surface of the support may be subjected to a pre-treatment such as a corona discharge treatment, an ultraviolet irradiation, a flame treatment, etc.

The photographic element used in this invention comprises a support and at least one dye image providing unit layer. In the case of a multicolor photographic element, the photographic element has on a support at least two dye image providing unit layers each recording light in a different spectral range. The unit layer contains light sensitive silver halide grains, is generally spectrally sensitive to light, and has a color coupler associated therewith. The dye image providing layers are efficiently separated or isolated from each other by a barrier layer, an interlayer, a layer containing an agent for removing the oxidation product of a color developing agent, etc., for preventing each layer from forming color stains. Efficient isolation techniques for dye image providing unit layers are well known in the photographic art and are utilized widely in commercial color photographic products for preventing the formation of color stains. Moreover, a color photographic material with a development stain preventing layer as described in U.S. Pat. No. 3,737,317 and Japanese Patent Applications Nos. 73,445/73 and 113,633/73 can be used in this invention.

The photographic element used in this invention may be prepared by coating the photographic layers on a support using a dip coating method, an air knife coating method, a curtain coating method, or a coating method using the hopper described in U.S. Pat. No. 2,681,294. It is advantageous to coat two or more photographic layers on a support using the methods described in U.S. Pat. Nos. 2,761,791, 3,508,947 and 3,837,095.

The photographic elements used in this invention may further be so constituted as being suitable for the color image transfer processes as described in U.S. Pat. Nos. 3,087,817, 3,185,567, 2,983,606, 3,253,915, 3,227,550, 3,227,551, 3,227,552, 3,145,633, 3,415,645 and 3,415,646 as well as for the absorption transfer process as described in U.S. Pat. No. 2,882,156.

When dye preforming type couplers or oxidation-reduction dissociation type couplers are used in the photographic elements in this invention, at least two color image-providing unit layers each containing the coupler therein in an amount of at least about 40% excess on a molar basis over the stoichiometric amount of the coupler based on the amount of silver in the same layer are present.

The developer used in the process of this invention contains at least one of the various developing agents (reducing agents) as described hereinabove and can contain other developer components such as, for example, those described hereinabove in connection with the intensification solution.

Furthermore, the color developer used in this invention can contain the following components, for example, competing couplers such as citrazinic acid, J-acid, H-acid, etc., and those as described in Japanese Patent Publications Nos. 9,505/69, 9,506/69, 9,507/69, 9,508/69 and 14,036/70 and U.S. Pat. Nos. 2,742,832, 3,520,690, 3,560,212 and 3,645,737, fogging agents such as alkali metal borohydrides, aminoboranes, ethylenediamine, and those as described in Japanese Patent Publication No. 38,816/72, and compensating developing agents such as p-aminophenol, benzyl-p-aminophenol, 1-phenyl-3-pyrazolidone, and those as described in Japanese Patent Publications Nos. 41,475/70, 19,037/71 and 19,438/71. The amount of the compensating developing agent is preferably about 0.1 to 1.0 g/l.

The present invention can be applied to the developing solution which is employed in the following typical process described hereinbelow.

In one typical embodiment of the process, a silver halide color photographic material is developed and intensified with a processing solution containing the cobalt (III) complex and a primary aromatic amine color developing agent, blixed, washed with water, and dried, thus, to provide color images.

In another embodiment of the process, a silver halide color photographic material is developed with a developer containing a primary aromatic amine color developing agent, intensified, after being rinsed for a very short period of time or without being rinsed, with an intensification solution containing the cobalt (III) complex, blixed, washed with water, and dried to provide color images.

In still another embodiment of the process, a silver halide color photographic material having incorporated in the silver halide emulsion layer or layers or the adjacent layer or layers to the silver halide emulsion layer or layers a primary aromatic amine color developing agent is, without being processed with a developer, developed and intensified with an intensification solution containing the cobalt (III) complex, blixed, washed with water and dried to provide color images.

In a further embodiment of the process, a silver halide color photographic material is subjected to a so-called mono-bath processing for performing development, intensification, and blixing, namely, is processed with a processing solution containing a primary aromatic amine color developing agent, the cobalt (III) complex and the silver halide fixing agent, washed then with water, and dried to provide color images.

Moreover, in each of the above-described embodiments of the process, each fundamental processing step can be modified in various ways. For example, the blix step may be performed using a bleach step and a fix step separately or further additional baths such as a stabilization bath and a hardening bath may be added to the fundamental processing step. As the case may be, the blix step may be replaced by a fix step simply as employed suitably in the processing of X-ray photographic films. This modification is suitable for a reversal color process wherein a first development process comprising a black-and-white development is performed as the first step.

In another embodiment of the process, couplers may be incorporated in the color developer. Examples of the so-called diffusible couplers used in color developers are the cyan couplers described in, for example, U.S. Pat. Nos. 3,002,836 and 3,542,552, the magenta couplers described in, for example, Japanese Patent Publication No. 13,111/69 and the yellow couplers described in, for example, U.S. Pat. No. 3,510,306. In this case, the concentration of the coupler used is about 0.5 to about 5 g/l, in particular, 1 to 2.5 g/l.

In a color photographic system, dye images for subtractive color photography are formed using the color negative process as described in W. T. Hanson and W. I. Kesner, *Journal of the Society of Motion Picture and Television Engineers*, Vol. 61, 667–701 (1953) or a color reversal process using direct positive photographic emulsions or wherein a color photographic material prepared using negative photographic emulsion is image-wise exposed, developed in a black-and-white developer to form negative silver images, exposed further at least overall (or subjected to another appropriate fogging treatment), and then developed to form desirable colored dye images. In this case, in order to prevent the silver formed in the first development from acting as a catalyst, the photographic material is, after the black-and-white development, bleached and then, after color development, is intensified or alternatively is processed with a color developer containing the cobalt (III) complex.

The process of this invention can be employed in any of the above-described processes. That is, in any of these cases, fogging components can be removed from the processing solutions containing the cobalt (III) complexes by the process of this invention.

The process of this invention is superior to conventional processes and some of the advantages thereof are as follows:

First of all, the formation of fog in the system wherein the cobalt (III) complex is present together with a developing agent with the passage of time can be completely prevented.

Second, photographically undesirable actions such as a reduction in image density, etc., do not occur with the process of this invention.

Third, it is not necessary to incorporate the cobalt (III) complexes into photographic materials in the process of this invention, whereby stability difficulties of the photographic materials such as a reduction in sensitivity, etc., can be prevented.

Fourth, the cobalt (III) complex used in the process of this invention is less hazardous and can be easily handled as compared with a conventional hydrogen peroxide type intensifications.

Fifth, the process of this invention enables development and intensification to be performed simultaneously, which is quite difficult in the conventional intensification process using hydrogen peroxide. Thus, in the process of this invention, photographic materials can be stably processed without employing an additional intensification bath or without increasing the number of baths. Furthermore, since development, intensification, and blixing can be performed simultaneously, a so-called mono-bath color processing can be performed in the process of this invention in a stable manner.

The invention is explained in greater detail in the following examples but the invention is not to be construed as being limited to the embodiments shown in the examples. Unless otherwise indicated herein, all parts, percents, ratios and the like are by weight.

EXAMPLE 1

A photographic element composed of the following elements was prepared (1) Polyethylene-coated paper support.

(2) A layer of a blue-sensitive silver chlorobromide emulsion (20 mol% silver chloride) containing 150 mg/m$^2$ of silver, 1,500 mg/m$^2$ of gelatin, and 600 mg/m$^2$ of a yellow coupler α-pivaloyl-2-chloro-4-(4-benzyloxyphenylsulfonyl)phenoxy-5-[α-(2,4-di-t-amylphenoxy)butanamido]acetanilide dispersed in 300 mg/m$^2$ of dioctylbutyl phosphate.

(3) A layer containing 1,000 mg/m$^2$ of gelatin.

(4) A layer of a green-sensitive silver chlorobromide emulsion (70 mol% silver chloride) containing 100 mg/m$^2$ of silver, 800 mg/m$^2$ of gelatin, and 350 mg/m$^2$ of a magenta coupler, 1-(2,4,6-trichlorophenyl)-3-[(2-chloro-5-tetradecanamido)anilino]-2-pyrazolin-5-one dispersed in 170 mg/m$^2$ of tricresyl phosphate.

(5) A layer containing 1,000 mg/m$^2$ of gelatin, 50 mg/m$^2$ of an ultraviolet absorbent, and 50 mg/m$^2$ of dioctylhydroquinone.

(6) A layer of a red-sensitive silver chlorobromide emulsion (70 mol% silver chloride) containing 100 mg/m$^2$ of silver, 700 mg/m$^2$ of gelatin, and 300 mg/m$^2$ of a cyan coupler, 2-[α-(2,4-di-t-amylphenoxy)-butanamido]-4,6-dichloro-5-methylphenol dispersed in 150 mg/m$^2$ of n-butyl phthalate.

(7) A layer containing 1,000 mg/m$^2$ of gelatin.

The photographic material thus prepared was exposed (500 CMS; 2854° C. color temperature; 1 sec) by means of a sensitometer and then subjected to the following processings.

| Processing Steps | Temperature (° C.) | Time |
|---|---|---|
| Color Development | 40 | 4 min |
| Intensification | | |
| Blix | " | 1 min 30 sec |
| Wash | 26 | 1 min 30 sec |
| Dry | | |

The compositions of the processing solutions used in the above processing were as follows:

| | |
|---|---|
| **Color Developer** | |
| Benzyl Alcohol | 10ml |
| Sodium Sulfite | 2g |
| Hydroxylamine Sulfate | 2g |
| Sodium Bromide | 0.59 |
| Sodium Chloride | 0.59 |
| N-Ethyl-N-methoxyethyl-3-methyl-p-phenylenediamine-di-p-toluenesulfonate | 5g |
| Sodium Carbonate (monohydrate) | 30g |
| Di-sodium Ethylenediaminetetraacetate | 5g |
| Water to make | 1l (pH 10.0) |
| **Blix Solution** | |
| Di-sodium Ethylenediaminetetraacetate | 5g |
| Glacial Acetic Acid | 20ml |
| Ammonium Thiosulfate (70% aq. soln.) | 130ml |
| Sodium Sulfite | 15g |
| Cobalt (III) Hexamine Chloride | 3g |
| Water to make | 1l (pH 4.5) |

The photographic properties of the color images thus formed are shown in Table 1 below.

Then, the color developer was placed in a reagent bottle and after storage for 48 hours at 40° C., the same procedure as above was repeated.

Separately, the color developer was stored for 48 hours at 40° C., brought into contact with a 0.5 M aqueous phosphoric acid solution through a porous Teflon film (thickness 0.40 mm, maximum pore size 2.1μ, porisity 80.5%, and density 0.43 g/cm$^2$) inserted between both solutions for 6 hours, and then the same processing as above was performed using the developer thus treated.

The results obtained in the above two processings are also shown in Table 1.

TABLE 1

| | Fog* | | | Maximum Density | | |
|---|---|---|---|---|---|---|
| | R | G | B | R | G | B |
| Fresh Developer | 0.11 | 0.08 | 0.16 | 2.54 | 2.50 | 2.48 |
| Stored Developer | 0.54 | 0.30 | 0.58 | 2.57 | 2.52 | 2.42 |
| Stored Developer Contacted with Porous Teflon | 0.11 | 0.09 | 0.17 | 2.54 | 2.48 | 2.46 |

TABLE 1-continued

| | Fog* | | | Maximum Density | | |
|---|---|---|---|---|---|---|
| | R | G | B | R | G | B |
| Film** | | | | | | |

*The value of the fog includes the base density.
**This invention.

As shown by the results in the above table, when the color developer stored for 48 hours at 40° C. was used, fog was formed greatly, which shows that the color developer containing the cobalt (III) complex is poor from a practical standpoint when used in a conventional manner. On the other hand, when the color developer stored for 48 hours at 40° C. was used after removing therefrom fogging components using the porous Teflon film according to the process of this invention, the degree of fog formation was almost the same as that in the case of using the fresh color developer. Furthermore, in the latter case, the maximum density was almost the same as that in the case of using the fresh developer.

EXAMPLE 2

A photographic element having the same structure as that of the photographic material described in Example 1 was exposed as in Example 1 and subjected to the following processings.

Processing steps: Same as that described in Example 1.

The compositions of the processing solutions used in this example were as follows:

| Color Developer | |
|---|---|
| Sodium Sulfite | 2g |
| Hydroxylamine Sulfate | 2g |
| Potassium Bromide | 0.5g |
| Sodium Chloride | 0.5g |
| N-Ethyl-N-methoxyethyl-3-methyl-p-phenylenediamine-di-p-toluenesulfonate | 5g |
| Sodium Carbonate (monohydrate) | 30g |
| Diethylenetriamine Pentaacetic Acid | 5g |
| Water to make | 1l |
| | (pH 10.0) |

Blix solution: Same as that described in Example 1.

The photographic properties of the color image formed are shown in Table 2 below.

Then, 1 liter of the color developer was placed in a reagent bottle and after storage for 48 hours at 40° C., the same processing as above was carried out using the color developer thus stored.

Separately, a porous Teflon tube (inside diameter of the tube 3.6 mm; length 1 meter; thkckness 0.5 mm; maximum pore size 3.0μ; porosity 73%; and density 0.6 g/cm$^3$) was placed in a reagent bottle and the porous Teflon tube was filled with a 1.0 M aqueous sulfuric acid solution. Then, 1 liter of the color developer was placed in the reagent bottle, i.e., in the space between the Teflon tube and the reagent bottle, and after storage of the developer for 48 hours at 40° C., the same processing was performed using the color developer thus stored.

The photographic properties of the color images thus formed in both processings are also shown in Table 2 below.

TABLE 2

| | Fog | | | Maximum Density | | |
|---|---|---|---|---|---|---|
| | R | G | B | R | G | B |
| Fresh Developer | 0.15 | 0.08 | 0.10 | 2.48 | 2.43 | 2.42 |
| Stored Developer | 0.52 | 0.28 | 0.54 | 2.50 | 2.45 | 2.40 |
| Stored Developer Contacted with Porous Teflon Tube (this invention) | 0.15 | 0.08 | 0.11 | 2.46 | 2.42 | 2.41 |

As shown by the results in the above table, when the color developer stored for 48 hours at 40° C. was used, fog formed greatly. On the other hand, when the color developer stored under the same conditions in the reagent bottle having placed therein a porous Teflon tube containing the aqueous sulfuric acid solution was used, the degree of fog formation was almost the same as that in the case of using the fresh color developer. Furthermore, in the latter case, scarcely any reduction in the maximum density was observed.

EXAMPLE 3

A photographic element having the same structure as that of the photographic element described in Example 1 was exposed as in Example 1 and subjected to the following processings.

| Processing Steps | Temperature (° C.) | Time (min) |
|---|---|---|
| Color Development and Intensification | 40 | 5 |
| Blix | " | 1 |
| Wash | 30 | 1 |

The compositions of the processing solutions used in this example were as follows:

| Color Developer | |
|---|---|
| Benzyl Alcohol | 10ml |
| Sodium Sulfite | 2g |
| Hydroxylamine Sulfate | 2g |
| Potassium Bromide | 0.5g |
| Potassium Chloride | 0.5g |
| 4-Amino-N-ethyl-N-(β-methanesulfonamido)-m-toluidine Sesquisulfate (monohydrate) | 6g |
| Cobalt (III) Hexaamine Chloride | 1.2g |
| Diethylenetriaminepentaacetic Acid | 5g |
| Water to make | 1l |
| | (pH 9.8) |
| **Blix Solution** | |
| Ammonium Thiosulfate (70% aq. soln.) | 150ml |
| Sodium Sulfite | 5g |
| Sodium Iron (III) Ethylenediaminetetraacetate | 20g |
| Disodium Ethylenediaminetetraacetate | 2g |
| Glacial Acetic Acid | 10ml |
| Water to make | 1l |
| | (pH 6.0) |

The photographic properties of the color images thus formed are shown in Table 3 below.

Then, the color developer was placed in a reagent bottle and after storage for 48 hours at 40° C., the same processing as above was repeated using the color developer thus stored.

Separately, the color developer was similarly stored for 48 hours at 40° C., a porous Teflon tube (inside diameter of the tube 3.6 mm; length 3 meters; thickness 0.5 mm; maximum pore size 1.7μ; porosity 65%; density 0.6 g/cm$^3$) was inserted into the color developer thus stored, and a 0.5 M aqueous phosphoric acid solution was passed through the tube at a rate of 5 ml/min. After passing the phosphoric acid solution for 6 hours, the same processing as above was repeated using the color developer thus treated.

The photographic properties of the color images thus formed in both processings are shown in Table 3 below.

TABLE 3

| | Fog | | | Maximum Density | | |
|---|---|---|---|---|---|---|
| | R | G | B | R | C | B |
| Fresh Developer | 0.15 | 0.09 | 0.11 | 2.54 | 2.41 | 2.39 |
| Stored Developer | 0.43 | 0.24 | 0.45 | 2.52 | 2.34 | 2.33 |
| Stored Developer Contacted with Porous Teflon Tube (this invention) | 0.16 | 0.09 | 0.12 | 2.52 | 2.39 | 2.37 |

As shown by the results in the above table, when the color developer stored for 48 hours at 40° C. was used, fog formed greatly. On the other hand, when the color developer stored under the same conditions as above while removing fogging components therefrom through the porous Teflon tube was used, the degree of fog formation was almost the same as that in the case of using the fresh color developer. The maximum density in the latter case was almost the same as that in the case of using the fresh color developer.

While the invention has been described in detail and with reference to specific embodiments thereof, it will be apparent to one skilled in the art that various changes and modifications can be made therein without departing from the spirit and scope thereof.

What is claimed is:

1. In a process of forming photographic images by processing an imagewise exposed and color developed photographic element comprising a support having at least one photographic layer with an image-wise distributed material possessing a catalytic activity thereon with a photographic processing solution containing at least a cobalt (III) complex having a coordination number of 6 in the presence of a primary aromatic amine developing agent, the improvement which comprises preventing the formation of fog on the photographic images by contacting the photographic processing solution with one side of a fine open-cell porous diaphragm having a mean pore size of 0.1 to 1000 microns of a hydrophobic material comprising higher than 50% polytetrafluoroethylene content, the other side of which is in contact with an aqueous acid solution having an acid concentration of about 0.001 to 10 mol/l, whereby fogging components are removed from the processing solution into the acid solution through the porous diaphragm.

2. The process as set forth in claim 1, wherein said hydrophobic material is polytetrafluoroethylene.

3. The process as set forth in claim 1, wherein said hydrophobic material is a mixture of polytetrafluoroethylene and polyethylene, polypropylene, or polyvinyl chloride.

4. The process as set forth in claim 3, wherein said acid solution is an aqueous solution of an organic acid or an inorganic acid.

5. The process as set forth in claim 4, wherein said inorganic acid is hydrochloric acid, nitric acid, sulfuric acid, phosphoric acid or boric acid.

6. The process as set forth in claim 4, wherein said organic acid is acetic acid, propionic acid, maleic acid, citric acid, oxalic acid, malic acid or toluenesulfonic acid.

7. The process as set forth in claim 4, wherein said fine open-cell porous diaphragm comprises a sheet-like diaphragm and said porous diaphragm is disposed between the photographic processing solution containing the fogging components and the aqueous solution of the inorganic acid or the organic acid.

8. The process as set forth in claim 4, wherein said fine open-cell porous diaphragm comprises a tube and one of the photographic processing solution containing the fogging components or the aqueous solution of the inorganic acid or the organic acid is displaced in the tube and the other is disposed outside the tube.

9. The process as set forth in claim 1, wherein said fine open-cell porous diaphragm has a thickness of about 0.01 to about 5 mm.

10. The process as set forth in claim 1, wherein the primary aromatic amine developing agent is present in said photographic processing solution with the cobalt (III) complex.

11. The process as set forth in claim 1, wherein said material possessing a catalytic activity is silver.

12. The process as set forth in claim 1, wherein said material possessing a catalytic activity is platinum, palladium, copper, gold, mercury, carbon, copper sulfide or silver sulfide.

13. The process as set forth in claim 1, wherein said photographic processing solution is an intensifying solution for color images formed by color development.

14. The process as set forth in claim 1, wherein said photographic processing solution is a color developing and intensifying solution containing the cobalt (III) complex and the primary aromatic amine developing agent.

15. The process as set forth in claim 1, wherein said photographic processing solution is a mono-bath processing solution capable of performing color development, intensification, and blixing, said solution containing the primary aromatic amine developing agent, the cobalt (III) complex, and a fixing agent.

16. The process of claim 1 wherein said acid solution is an aqueous solution of an organic acid or an inorganic acid, said inorganic acid being selected from the group consisting of hydrochloric acid, nitric acid, sulfuric acid, phosphoric acid and boric acid; said organic acid being selected from the group consisting of acetic acid, propionic acid, maleic acid, citric acid, oxalic acid, malic acid or toluenesulfonic acid.

* * * * *